United States Patent [19]

Ray et al.

[11] Patent Number: 4,514,934

[45] Date of Patent: May 7, 1985

[54] METHOD AND APPARATUS FOR ABRASIVELY MACHINING A WORKPIECE

[75] Inventors: Robert W. Ray; Rex G. Pierce, both of Joliet, Ill.

[73] Assignee: Caterpillar Tractor Co., Peoria, Ill.

[21] Appl. No.: 394,731

[22] PCT Filed: May 10, 1982

[86] PCT No.: PCT/US82/00623

§ 371 Date: May 10, 1982

§ 102(e) Date: May 10, 1982

[87] PCT Pub. No.: WO83/03994

PCT Pub. Date: Nov. 24, 1983

[51] Int. Cl.[3] ..... B24B 49/14

[52] U.S. Cl. ..... 51/165 R; 51/165.73; 51/267; 51/322; 51/289 R; 324/238

[58] Field of Search ..... 51/165.73, 165.77, 165 R, 51/281, 322, 165.92, 267, 289 R; 324/222, 226, 237, 238, 240

[56] References Cited

U.S. PATENT DOCUMENTS

| | | | |
|---|---|---|---|
| 2,427,064 | 9/1947 | Moul | 51/122 |
| 3,341,983 | 9/1967 | Baldenhofer | 51/267 |
| 3,646,839 | 3/1972 | Shillam | 82/1 |
| 3,653,855 | 4/1972 | Smith | 51/165.77 |
| 3,810,002 | 5/1974 | Sata | 324/34 R |
| 3,939,404 | 2/1976 | Tait | 324/238 |
| 3,992,826 | 11/1976 | Nakaoka | 51/35 |
| 4,095,469 | 6/1978 | Yamada | 324/222 |
| 4,118,900 | 10/1978 | Moritomo et al. | 51/281 R |
| 4,258,319 | 3/1981 | Shimada | 324/226 |

FOREIGN PATENT DOCUMENTS

| | | |
|---|---|---|
| 2162987 | 7/1973 | France . |
| 2390729 | 8/1978 | France . |

OTHER PUBLICATIONS

"Eddy-Current Testing", *Tool and Manufacturing Engineers Handbook,* 3rd Edition, pp. 33–21 thru 33–23, 1976, McGraw-Hill, New York.

*Primary Examiner*—Harold D. Whitehead
*Attorney, Agent, or Firm*—Robert A. McFall

[57] ABSTRACT

A method and apparatus for abrasively machining a workpiece (12) includes the establishment of an eddy-current in the workpiece (12) at an area (33) where an abrasive tool (14) contacts the workpiece (12).

Cooling liquid is also directed over the working area.

14 Claims, 2 Drawing Figures

METHOD AND APPARATUS FOR ABRASIVELY MACHINING A WORKPIECE

DESCRIPTION

1. Technical Field

This invention relates generally to a method and apparatus for abrasively machining a workpiece and more particularly to a method and apparatus for controllably grinding ferrous metal workpieces.

2. Background Art

A number of attempts have been made to control abrasive machining operations to prevent overheating the workpiece. In particular, several attempts have been made to control the amount of heat input to a metal workpiece during grinding operations, by limiting contact pressure between the grinding tool and the workpiece, or by controlling feed rate, wheel speed, coolant flow, or dressing speed and feed. In general, grinding processes are controlled by establishing a predetermined value for one or more of the above operating parameters and then limiting the grinding machine operation to less than the predetermined values. An example of such a control method is disclosed in U.S. Pat. No. 4,118,900, issued Oct. 10, 1978 to Sodao Moritomo et al.

However, it has been found that even by limiting grinding machine operation to predetermined —and presumably safe—values, it is not always possible to produce defect-free articles. For example, it has been found that different grinding wheels manufactured by the same manufacturer vary in quality and have different grinding characteristics. It has also been found that in a single grinding wheel, grinding characteristics may vary as the wheel wears. Often the change in grinding characteristics, during operation, are such that the predetermined operating parameters are not adequate to safeguard the workpiece from damage and as a result of production of excess heat, the workpieces are damaged.

The present invention is directed to overcoming one or more of the problems as set forth above by sensing changes in the workpiece resulting from the abrasive machining operation as the changes occur during the operation.

DISCLOSURE OF THE INVENTION

In accordance with one aspect of the present invention, a method for abrasively machining a workpiece by contacting the workpiece with an abrasive tool includes establishing an eddy-current in the workpiece at an area where the tool contacts the workpiece, sensing any change in the eddy-current in response to change in the microstructure of the workpiece, and controlling the abrasive machining operation in response to the sensed change in microstructure.

In another aspect of the present invention, an apparatus for abrasively machining a workpiece by contacting the workpiece with an abrasive tool and moving the workpiece or the tool relative to one another includes a means for establishing an eddy-current in the workpiece and sensing any change in the eddy-current in response to change in the microstructure of the workpiece resulting from the abrasive machining operation and generating an output signal responsive to the sensed change in microstructure.

Heretofore, it has not been possible to detect small changes in the microstructure of a workpiece during a grinding operation. Detection of grinder burn on the surface of a workpiece has been a particularly vexatious problem. Grinding burn is generally characterized as small undesirable changes in the surface morphology or microstructure of metallic workpieces resulting from the grinding operation. Each grinding parameter such as dressing, feed rate, coolant, or wheel composition and quality, can cause grinder burn. The detection of grinder burn has previously been possible only by destructive test techniques such as etching, polishing, or indentation hardness measurements.

The present invention not only provides a method of non-destructively detecting grinder burn, but also permits the detection of grinder burn at its very incipiency and provides a method of controlling the abrasive machining process to prevent the burn from progressing beyond predetermined allowable limits. Further, the present invention provides a method and apparatus that is particularly useful in controllably grinding hardened ferrous metal workpieces and consistently producing such workpieces having a burn-free surface.

BEST MODE FOR CARRYING OUT THE INVENTION

Figure 1:
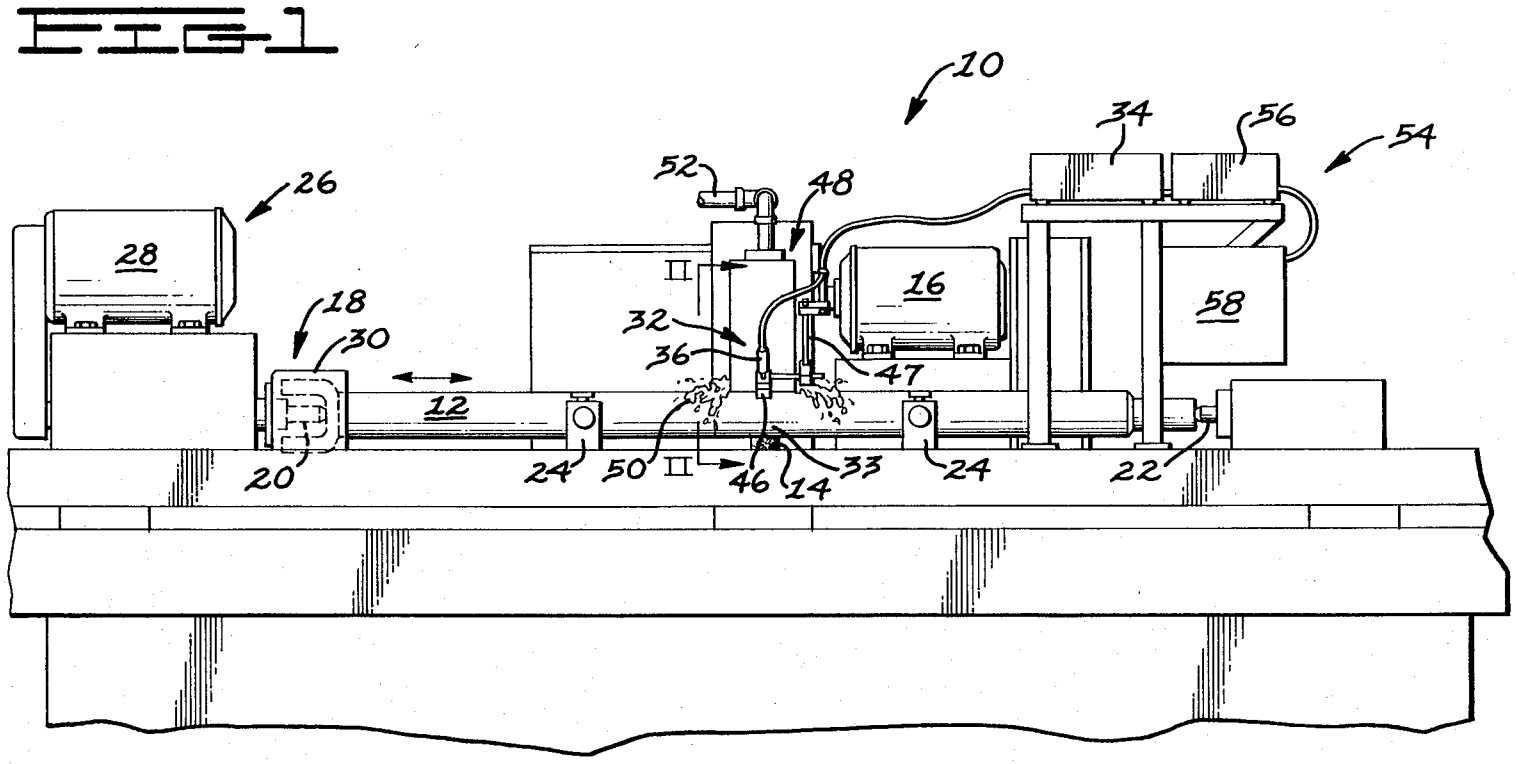
FIG. 1 is a partial elevational view of a grinding machine representing an embodiment of the present invention.

In the preferred embodiment of the present invention, an apparatus 10, such as a grinder, for abrasively machining a workpiece 12 by contacting the workpiece 12 with an abrasive tool 14, for example a grinding wheel, and moving at least one of the workpiece 12 and the tool 14 relative to the other is shown generally in FIG. 1. More specifically, the grinder 10 is a center-type grinder adapted for traverse grinding of an elongated shaft 12. The grinding wheel 14 is rotatably mounted on the grinder and is driven in a clock-wise direction, as viewed in FIG. 2, by a motor 16. The grinding wheel is also laterally moveable with respect to the central axis workpiece 12, the magnitude of the lateral movement being controllable to permit incremental feed of the grinding wheel 14 into the workpiece 12.

The apparatus 10 also includes a means 18 for supporting the workpiece 12 on the apparatus 10. The means 18 includes a pair of spaced center supports 20,22 that, after mounting the workpiece therebetween, are coupled together for compliant movement in an axial direction along the workpiece central axis, i.e., in a direction transverse to the radial plane of the grinding wheel. The workpiece support means may also include one or more adjustable steady rests 24 as shown in FIG. 1.

A means 26 for moving at least one of the workpiece 12 or the tool 14 with respect to each other includes the aforementioned grinding wheel drive motor 16, and in the preferred embodiment, a motor not shown for moving the grinding wheel into contact with the workpiece 12, and a workpiece drive motor 28. The workpiece drive motor 28 is connected to the workpiece 12 by a coupling 30 incorporated in the center support 20 to rotate the workpiece 12 in a counter-clockwise direction as viewed in FIG. 2.

The apparatus 10 also includes a means 32 for establishing an eddy-current in the workpiece 12 at an area 33 where the tool 14 contacts the workpiece 12 and sensing any change in the eddy-current in response to change in the microstructure of the workpiece 12 resulting from the abrasive machining operation, and generating an output signal responsive to the sensed change in microstructure. In the preferred embodiment, the means 32 for establishing an eddy-current in the workpiece 12 includes an eddy-current tester 34 and a probe 36 coupled to the tester 34. It has been found that a model M900-I Verimet single channel hardness and alloy tester and a waterproofed model 15887 M100 0.625 inch (15.9 mm) hardness and alloy probe, both manufactured by K. J. Law Engineers, Inc. of Farmington Hills, Mich., USA, are particularly suitable for incorporation into the abrasive machining apparatus 10 of the present invention. The Verimet tester 34 is adapted to provide a current having a single fixed frequency of about 80,000 Hz to the probe 36, and has a zero suppression bias control 38, a reject limit bias control 40, a three-color status light 42, and an analog display meter, such as a milliammeter 44 to monitor the sensed signal.

Figure 2:
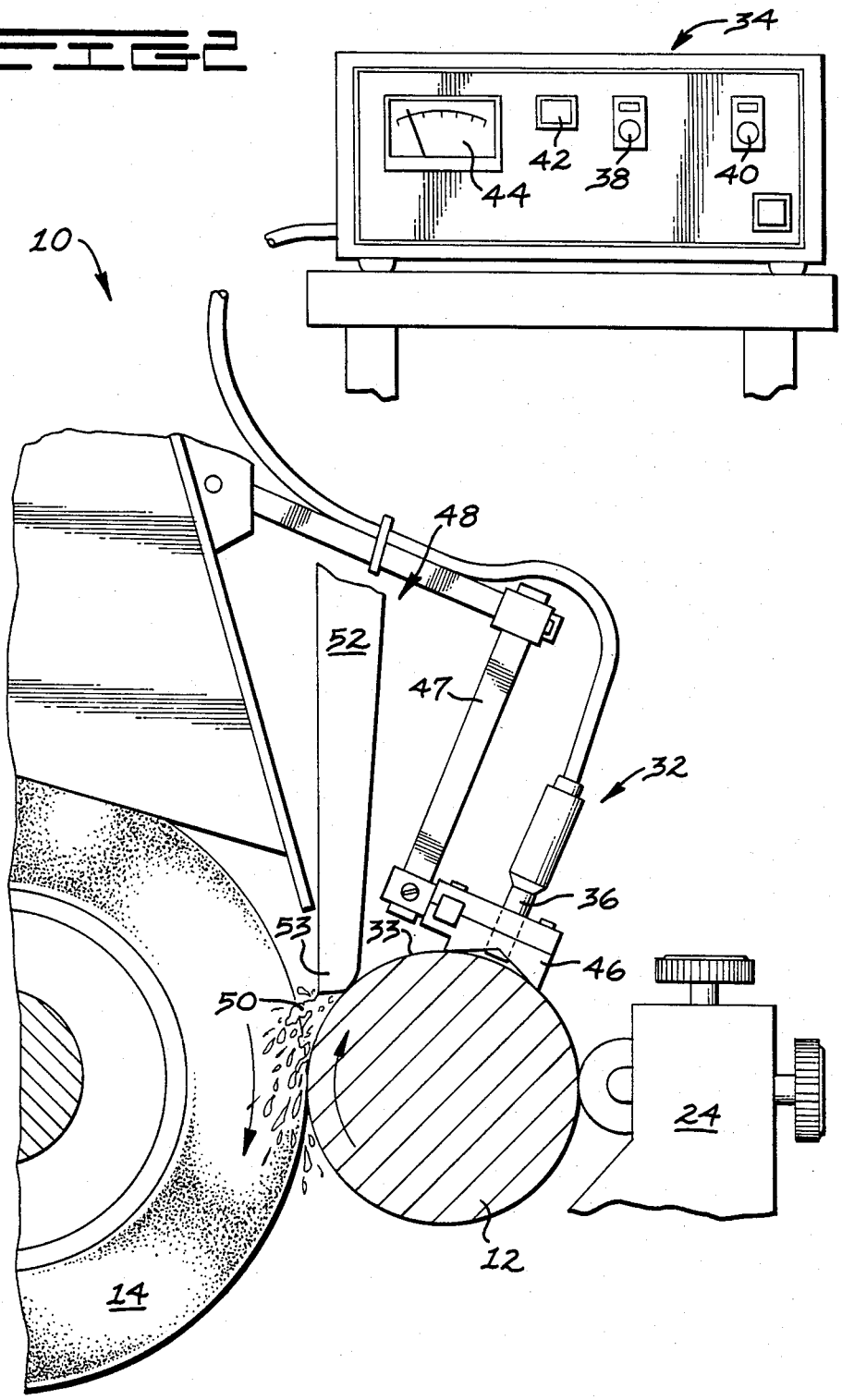
FIG. 2 is a sectional view of the embodiment of the present invention taken along the lines II—II of FIG. 1.

The probe 36 is adjustably mounted in a wear-resistant V-block 46 constructed of a low-friction material such as carbon-impregnated nylon. The V-block 46 is pivotally and adjustably supported from the grinder frame by an adjustable bar linkage 47 as shown in FIGS. 1 and 2. The position of the probe 36 is thus adjustable with respect to the workpiece 12 and is moveable between a position at which the V-block rests on the workpiece 12 at the tool contact area 33 during operation of the grinding process, and a position spaced from the workpiece when the workpiece 12 is being placed in, or removed from, the grinder 10. If the probe 36 is allowed to contact the workpiece 12 during rotation of the workpiece 12, the probe tip may become worn resulting in damage to the probe 36. The probe 36 is therefore positioned within the V-block 46 so that when the V-block 46 is in contact with the workpiece 12, the distal end of the probe 36 is spaced a predetermined distance from the workpiece 12. Typically this stand-off distance is initially set at about 0.022 inch (0.56 mm) to permit some wear to occur in the workpiece-contacting surfaces of the V-block and still maintain a safe non-contacting distance between the probe 36 and the workpiece 12.

A means 48 for delivering a supply of coolant 50 to the surface of the workpiece 12 includes a coolant delivery tube 52 connected to a source of the coolant 50, such as a tank or reservoir, not shown. A discharge end 53 of the delivery tube 52 is directed towards the interface, or contact area, between the grinding wheel 14 and the workpiece 12 and preferably, as shown in FIG. 2, is directed so that the coolant 50 also contacts a surface portion of the workpiece 12 after the surface portion is abraded by the tool 14 and before that same surface portion is sensed by the probe 36.

The apparatus 10 may also include a second means 54 for controlling the above-described means 26 for moving at least one of the workpiece 12 or the tool 14 relative to the other in response to receiving an output signal from the first means 32. Typically, the second means 54 includes a signal processor 56 and a machine controller 58. The signal processor 56 is constructed to receive a signal generated by the eddy-current tester 34 responsive to sensed changes in the microstructure of workpiece 12, compare the sensed change to a preselected value, determine undesirable microstructure in the workpiece in response to the magnitude of the difference between the preselected value and the sensed value, and deliver an output signal to the machine controller 58. The machine controller 58, in response to receiving the signal from the signal processor 56, will deliver a signal to one or more elements of the means 26 for moving either the workpiece 12 or the tool 14 with respect to one another.

INDUSTRIAL APPLICABILITY

A method for abrasively machining a ferrous metal workpiece without producing undesirable grinder burn on the surface of the workpiece has been successfully developed using the apparatus 10 of the present invention. In one example of the method according to the present invention, the workpiece 12 is an hydraulic piston rod having a ground surface length of about 49 inches (1.24 mm) and a diameter of about 4 inches (0.10 mm). The rod 12 has a ferrous metal composition identified as SAE 1049 plain carbon steel. The rod is direct hardened to Brinell 3.6–3.9 mm and then turned on a lathe to a diameter 0.070 inch (1.78 mm) greater than the desired final ground diameter. After turning, the rod is induction hardened to provide a 0.135 inch (34 mm) deep case having a hardness in the range of $R_c$ 58–62. The microstructure of the hardened case is 100% martensitic and the grain size is ASTM 5 (ASTM E112) or finer.

After case hardening, the rod 12 is straightened and then centered on the center supports 20,22 of the grinder 10, a flow of coolant 50 is directed onto the rod 12 at the tool contact area 33 in radial alignment with the grinding wheel 14, and the V-block 46 holding the eddy-current probe 36 is lowered into contact with the rod 12. As shown in the drawings, the probe 36 is aligned with the radial plane of the wheel 14 and circumferentially positioned on the rod 12 at the area of contact between the rod 12 and the wheel 14. The motor 16 is modulated to rotate the grinding wheel 14 at a rate of about 1100 rpm in the clockwise direction of FIG. 2 and the motor 28 is controlled to rotate the rod 12 at a rate of about 90–120 rpm in a direction counter to the grinding wheel 14 rotation. The center suports 20,22 are slowly traversed back and forth, in unison, in the direction indicated by the arrows in FIG. 1, thereby sequentially passing the entire length of the rod 12 past the plane of the grinding wheel 14. The initial pick-feed, or rate at which the grinding wheel 14 is moved in a radial direction towards the rod 12 is about 0.003 inch (0.075 mm) for each traverse of the rod 12. The pick-feed rate is gradually reduced to about 0.0005 inch (0.012 mm) as the outer diameter of the rod 12 approaches the desired finish-ground dimension.

The potentiometers of the zero suppression bias control 38 and the reject limit bias control 40 of the Verimet eddy-current tester are set to read 745 and 425, respectively. For the particular workpiece described above, these values will center the needle of the analog display 44 when the probe is positioned in the V-block on the rod 12 and the hardness of the rod 12 is within the prescribed range of $R_c$ 58–62. Also, the status light 42 will show "green" as long as the V-block rides on the rod surface and surface hardness is above $R_c$ 53. If the surface hardness drops to less than $R_c$ 53, the status light will show "red".

It has been found that as the grinding operation progresses, heat generated as a result of the abrasive removal of material from the rod 12 tends to temper the hardened case of the rod—a phenomenon characteristically identified as grinder burn. At the very start of any tendency to temper, the probe 36 senses a change in the microstructure in the area 33 of the rod 12 where the wheel 14 has just contacted the workpiece, and the changed value is reflected by movement of the needle of the analog display meter 44. It has been found that changes in microstructure resulting in tempering of the surface by less than 2 points on the Rockwell "C" scale can be identified by monitoring the needle deflection of the meter 44. When an operator observes deflection of the meter needle indicating the start of a burn condition, he immediately takes corrective action. In the present example, it is found that increasing the rotational speed of the rod 12 is generally sufficient to lower the heat input to the rod and thereby cause the needle of the meter 44 to again be centered. If, however, increasing the workpiece rotational speed does not correct the indicated possibility of excess burn, additional steps may be taken such as adjusting one or more of the various operating parameters, e.g., traverse speed, pick-feed rate, grinding wheel speed, coolant flow or dressing speed or feed.

An important advantage of the present invention is that the operator is now able to immediately identify the effect that each change in one of the operating parameters has on the surface microstructure of the workpiece. Thus, the operator is able to compare the sensed change (the instant needle position) with a preselected value (the adjusted center value on the meter scale), determine undesirable microstructure in the workpiece 12 in response to the magnitude of the difference between the preselected value and the sensed value, and control the abrasive machining operation in response to the sensed change in microstructure.

Further, it can be appreciated that the signal generated by the eddy-current tester 34 and displayed on the analog display meter 44, may alternatively be directed to the signal processor 56 having a micro-computer incorporating a logic program similar to the above-described operator reactive control technique. For example, the signal processor can selectively deliver a signal to the control apparatus 58, such as a conventional numerically controlled (NC) machine control, and selected operating parameters can be incrementably adjusted. The effect of the selected incremental adjustments can be compared by the signal processor program to determine if the adjustment was correct and, if required, deliver additional signals to the control apparatus 58.

The method and apparatus of the present invention enables an operator, or alternatively a computer-controlled control unit to determine the optimum value for each of the various operating parameters and thereby obtain the maximum material removal rate consistent with the avoidance of grinder burn. Further, it is now possible to monitor grinding operations and identify undetected changes in machine operation, such as loss of coolant or faulty grinding wheels.

Other aspects, objects, and advantages of this invention can be obtained from a study of the drawings, the disclosure, and the appended claims.

We claim:

1. In a method for abrasively machining a workpiece (12) by contacting the workpiece (12) with an abrasive tool (14) and moving at least one of the workpiece (12) and the tool (14) relative to the other, the improvement comprising:

directing a flow of coolant (50) to the workpiece (12) at an area (33) where the abrasive tool (14) contacts the workpiece (12);

establishing an eddy-current in the workpiece during an abrasive machining operation (12) at said area (33) on the workpiece (12);

sensing a change in the properties of the eddy-current in response to a change in the microstructure of the workpiece (12) at said area (33);

comparing the sensed change to a preselected value;

determining the magnitude of the difference between the preselected value and the sensed value; and, controlling the abrasive machining operation in response to said sensed change in microstructure.

2. The method, as set forth in claim 1, wherein said workpiece (12) is formed of a ferrous material.

3. The method, as set forth in claim 2, wherein said ferrous workpiece (12) includes a hardened outer case.

4. The method, as set forth in claim 1, wherein the step of sensing a change in the eddy-current includes generating a signal responsive to said sensed change and directing said signal to an analog display meter (44).

5. The method, as set forth in claim 1, wherein the step of sensing a change in the eddy-current includes generating a signal responsive to said sensed change and directing said signal to a signal processor (56) and said step of controlling the abrasive machining operation includes delivering a signal from said signal processor to a machine controller (58) for controlling the operation of said tool (14) with respect to said workpiece (12).

6. The method, as set forth in claim 1, wherein the abrasive machining operation is a grinding operation and the abrasive tool (14) is a grinding wheel (14).

7. The method, as set forth in claim 1, wherein the abrasive machining operation is a traverse grinding operation, the abrasive tool (14) is a grinding wheel (14), and the workpiece (12) is formed of ferrous metal having a hardened outer case.

8. A method for abrasively machining a ferrous metal workpiece (12), including the steps of:

contacting the workpiece (12) with an abrasive tool (14);

moving at least one of the workpiece (12) and the tool (14) relative to the other and abrading a surface area (33) on the workpiece (12);

cooling said surface area (33) on the workpiece (12);

establishing an eddy-current in the workpiece (12) at said area (33) on the workpiece (12);

sensing a change in the eddy-current in response to a change in the mirostructure of the workpiece (12) at said area (33);

comparing the sensed change to a preselected value;

determining the difference between the preselected value and the sensed value; and, controlling the abrasive machining operation in response to said sensed change in microstructure.

9. A method for grinding a ferrous metal workpiece (12), including the steps of:

contacting the workpiece (12) with a grinding wheel (14);

moving at least one of the workpiece (12) and the grinding wheel (14) relative one to the other;

directing a flow of coolant (50) to the workpiece (12) at the area of contact of the grinding wheel (14) with the workpiece (12);

establishing an eddy-current in the workpiece (12) at an area (33) where the tool (14) contacts the workpiece (12);

sensing any change in the eddy-current in response to change in the microstructure of the workpiece (12) resulting from the grinding operation; and, controlling the grinding operation in response to said sensed change in microstructure.

10. In an apparatus (10) for abrasively machining a workpiece (12) by contacting the workpiece (12) with an abrasive tool (14) and moving at least one of the workpiece (12) and the tool (14) relative to the other, the improvement comprising:

means (32) for establishing an eddy-current in the workpiece (12) at an area (33) where the tool (14) contacts the workpiece (12) and sensing a change in the eddy-current in response to a change in the microstructure of the workpiece (12) resulting from the abrasive machining operation and generating an output signal responsive to said sensed change in microstructure; and, means (48) for delivering a supply of coolant (50) to the surface of said workpiece (12) at said tool-contacting area (33).

11. The apparatus (10), as set forth in claim 10, wherein said apparatus (10) includes a second means (54) for controlling said apparatus (10) in response to receiving the output signal from said first means (32).

12. An apparatus (10) for abrasively machining a workpiece (12), including:

means (18) for supporting said workpiece (12) on said apparatus (10);

an abrasive tool (14) mounted on said apparatus (10);

means (26) for moving at least one of said workpiece (12) and said tool (14) relative to the other;

means (48) for delivering a supply of coolant (50) to the surface of said workpiece (12); and first means (32) for establishing an eddy-current in the workpiece (12) at an area (33) where the tool (14) contacts the workpiece (12) and sensing any change in the eddy-current in response to change in the microstructure of the workpiece (12) resulting from the abrasive machining operation and generating an output signal responsive to said sensed change in microstructure.

13. An apparatus (10), as set forth in claim 12, including second means (54) for controlling said means (26) for moving at least one of said workpiece (12) and said tool (14) relative to the other in response to receiving said output signal from said first means (32).

14. A grinder (10) for grinding a surface portion of a workpiece (12), including:

a workpiece support member (20,22) mounted on said grinder (10);

a grinding wheel (14) rotatably mounted on said grinder (10);

a coolant delivery tube (52) having a discharge end (53) disposed adjacent an area of contact of the grinding wheel (14) with the workpiece (12);

first means (32) for establishing an eddy-current in the workpiece (12) at an area where the grinding wheel (14) contacts the workpiece (12) and sensing any change in the eddy-current in response to change in the microstructure of the workpiece (12) resulting from the grinding operation and generating an output signal proportional to said sensed change in microstructure; and, second means (54) for controlling the grinder (10) in response to receiving the output signal from said first means (32).

* * * * *